US007031841B2

(12) United States Patent
Zazovsky et al.

(10) Patent No.: US 7,031,841 B2
(45) Date of Patent: Apr. 18, 2006

(54) METHOD FOR DETERMINING PRESSURE OF EARTH FORMATIONS

(75) Inventors: Alexander Zazovsky, Houston, TX (US); Julian J. Pop, Houston, TX (US); Paul S. Hammond, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 139 days.

(21) Appl. No.: 10/769,014

(22) Filed: Jan. 30, 2004

(65) Prior Publication Data

US 2005/0171699 A1 Aug. 4, 2005

(51) Int. Cl.
*E21B 49/10* (2006.01)

(52) U.S. Cl. ..... 702/12; 702/9; 73/152.05; 73/152.22; 175/48; 175/50; 166/250.02; 166/250.07; 166/250.08

(58) Field of Classification Search ..... 702/6, 702/9, 11, 12, 13; 73/152.05, 152.22; 166/250.02, 166/250.07, 250.08; 175/48, 50
See application file for complete search history.

(56) References Cited

U.S. PATENT DOCUMENTS

| | | | | |
|---|---|---|---|---|
| 3,934,468 | A | 1/1976 | Brieger | |
| 4,597,290 | A | 7/1986 | Bourdet et al. | |
| 4,833,914 | A | 5/1989 | Rasmus | |
| 4,860,581 | A | 8/1989 | Zimmerman et al. | |
| 5,144,589 | A | 9/1992 | Hardage | |
| 5,205,164 | A * | 4/1993 | Steiger et al. | 73/152.11 |
| 5,226,310 | A | 7/1993 | Steiger | |
| 5,282,384 | A | 2/1994 | Holbrook | |
| 5,285,692 | A | 2/1994 | Steiger et al. | |
| 5,415,030 | A | 5/1995 | Jogi et al. | |
| 5,602,334 | A | 2/1997 | Proett et al. | |
| 5,644,076 | A | 7/1997 | Proett et al. | |
| 5,672,819 | A | 9/1997 | Chin et al. | |
| 5,789,669 | A | 8/1998 | Flaum | |
| 6,157,893 | A | 12/2000 | Berger et al. | |
| 6,236,620 | B1 | 5/2001 | Schultz et al. | |
| 6,427,785 | B1 * | 8/2002 | Ward | 175/48 |
| 6,904,365 | B1 * | 6/2005 | Bratton et al. | 702/9 |

(Continued)

OTHER PUBLICATIONS

H. Asheim, "Analytical Solution of Dynamic Inflow Performance," *SPE 63307*, 2000 Ann. Tech. Conf. & Exh., Dallas, TX (Oct. 1-4, 2000).

(Continued)

*Primary Examiner*—Donald McElheny, Jr.
(74) *Attorney, Agent, or Firm*—J.L. Jennie Salazar; Brigitte L. Echols; Victor H. Segura

(57) ABSTRACT

A method for determining formation pressure at a depth region of formations surrounding a borehole, including: keeping track of the time since cessation of drilling at the depth region; deriving formation permeability at the depth region; causing wellbore pressure to vary periodically in time and determining, at the depth region, the periodic and non-periodic component of pressure measured in the formations; determining, using the time, the periodic component and the permeability, the formation pressure diffusivity and transmissibility and an estimate of the size of the pressure build-up zone around the wellbore at the depth region; determining, using the time, the formation pressure diffusivity and transmissibility, and the non-periodic component, the leak-off rate of the mudcake at the depth region; determining, using the leak-off rate, the pressure gradient at the depth region; and extrapolating, using the pressure gradient and the size of the build-up zone, to determine the formation pressure.

21 Claims, 10 Drawing Sheets

U.S. PATENT DOCUMENTS

| | | | | |
|---|---|---|---|---|
| 6,907,797 | B1 | 6/2005 | DiFoggio | |
| 2004/0144533 | A1 | 7/2004 | Zazovsky | |
| 2004/0176911 | A1* | 9/2004 | Bratton et al. | 702/6 |

OTHER PUBLICATIONS

Proett et al., "Real Time Pressure Transient Analysis Methods Applied to Wireline Formation Test Data," *SPE 28449*, 69th Ann. Tech. Conf. & Exh., New Orleans, LA, Sep. 25-28, 1994, pp. 891-906.

Proett et al., "Supercharge Pressure Compensation using a New Wireline Testing Method & Newly Developed Early Time Spherical Flow Models," *SPE 36525*, 1996 Ann. Tech. Conf. & Exh., Dallas, TX Oct. 6-9, 1996, pp. 329-342.

Proett et al., "New Exact Spherical Flow Solution with Storage and Skin for Early-Time Interpretation . . . " *SPE 49140*, 1998 Ann. Tech. Conf. & Exh., New Orleans, LA, Sep. 24-30, 1998, pp. 463-478.

Carnegie et al., "New Techniques in Wireline Formation Testing in Tight Reservoirs," *SPE 50128*, 1998 Asia Pacific Oil & Gas Conf. & Exh., Perth, Australia, Oct. 12-14, 1998, pp. 419-430.

Rosa et al., "Reservoir Description by Well Test Analysis using Cyclic Flow Rate Variation," *SPE 22698*, 66th Ann. Tech. Conf. & Exh., Dallas, TX, Oct. 6-9, 1991, pp. 433-448.

Proett et al., "Advanced Dual Probe Formation Tester with Transient, harmonic, and Pulsed Time-Delay Testing Methods . . . " *SPE 64650*, Int'l Oil & Gas Conf. & Exh., Beijing, China, Nov. 7-10, 2000.

Hollaender et al., "Harmonic Testing for Continuous Well and Reservoir Monitoring" *SPE 77692*, SPE Ann. Tech. Conf. & Exh., San Antonio, TX, Sep. 29, 2002-Oct. 2, 2002.

Meister et al., "Formation Pressure Testing during Drilling: Challenges and Benefits" *SPE 84088*, SPE Ann. Tech. Conf. & Exh., Denver, CO, Oct. 5, 2003-Oct. 8, 2003.

Silin et al., "A Well-Test Analysis Method Accounting for Pre-Test Operations," *SPE Journal*, Mar. 2003, pp. 22-31.

Sarkar et al., "Adverse Effects of Poor Mudcake Quality: A Supercharging and Fluid Sampling Study," *SPE Reservoir Eval. & Eng. 3* (*3*), Jun. 2000, pp. 256-262.

* cited by examiner

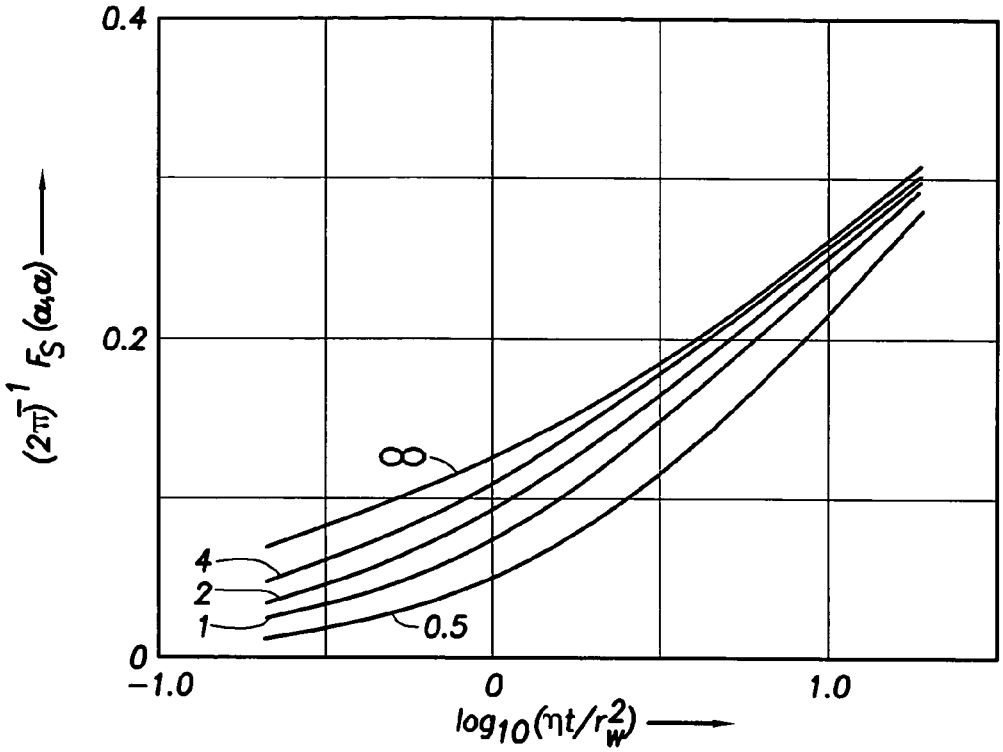
FIG.9
FIG.10
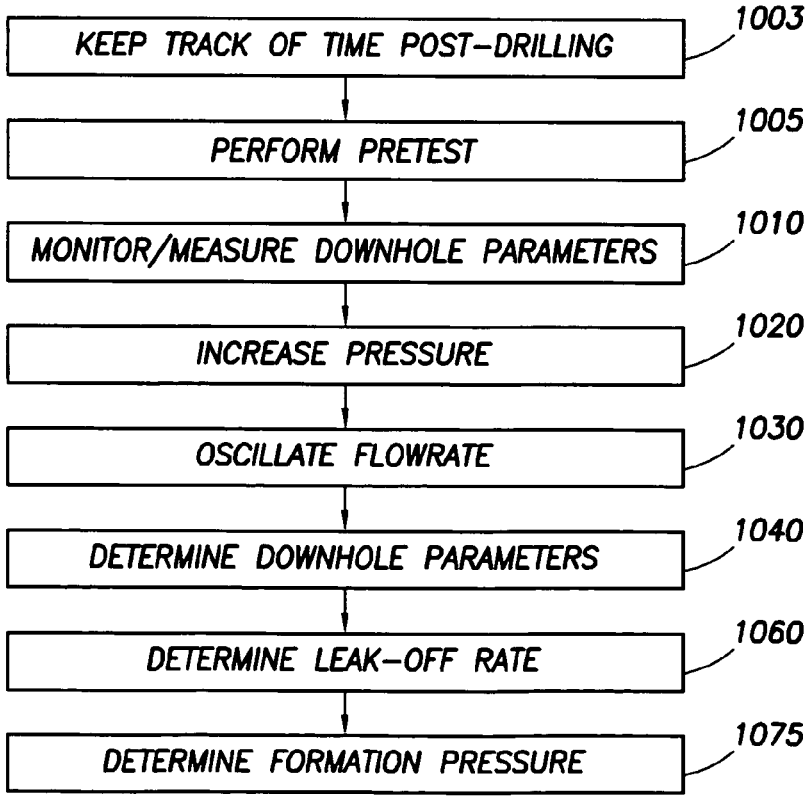

METHOD FOR DETERMINING PRESSURE OF EARTH FORMATIONS

FIELD OF THE INVENTION

The invention relates to determination of properties of formations surrounding an earth borehole and, more particularly, to a method for determining properties including the leak-off rate of a mudcake, the perturbing effect of drilling fluid leak-off, and the undisturbed virgin formation pressure.

BACKGROUND OF THE INVENTION

A serious difficulty of formation pressure determination during drilling operations is related to the pressure build-up around a wellbore exposed to overbalanced pressure and subject to filtrate leak-off called supercharging. This pressure build-up is accompanied by filter cake deposition and growth externally, at the sand face, and internally due to the mud filtrate invasion. Thus, the filter cake hydraulic conductivity changes with time, affecting the pressure drop across it and therefore the pressure behind it, at the sand face. This makes it difficult to predict the evolution of the pressure profile with time, even if the history of local wellbore pressure variation has been recorded.

Existing formation pressure measurements, made with so-called formation testing tools which probe the formations, often read high compared to the actual reservoir pressure far from the borehole, due to the supercharging effect. There are currently no known commercially viable techniques for the determination of the formation pressure in relatively low permeability reservoirs (below approximately 1 mD/cp) during drilling operations which adequately account for supercharging. The main difficulties are related to (1) the poor filter cake property, (2) the long actual time of wellbore exposure to overbalanced pressure, and (3) the practical time constraints, which require the pressure measurements to be carried out during a rather short time compared to the time of pressure build-up around a wellbore. These constraints make it difficult, if not impossible, to sense the far field formation pressure, at the boundary of the pressure build-up zone, with the usual transient pressure testing techniques, because of the slow pressure wave propagation inherent in low permeability formations.

Accordingly, while existing tools and techniques can often work well in relatively high permeability formations, where supercharging easily dissipates, e.g. during tool setting, there is a need for a technique that can be successfully employed in relatively low permeability formations. It is further desirable to have a technique that is applicable to formations of wide ranging permeability, irrespective of the origin of the supercharging. There is also a need for accurate determination of filtrate leak-off parameters. It is among the objects of the present invention to address these needs.

SUMMARY OF THE INVENTION

In accordance with an embodiment of the invention, a method is set forth for determining the virgin formation pressure at a particular depth region of earth formations surrounding a borehole drilled using drilling mud, and on which a mudcake has formed, comprising the following steps: keeping track of the time since cessation of drilling at said depth region; deriving formation permeability at said depth region; causing wellbore pressure to vary periodically in time and determining, at said depth region, the periodic component and the non-periodic component of pressure measured in the formations adjacent the mudcake; determining, using said time, said periodic component and said permeability, the formation pressure diffusivity and transmissibility and an estimate of the size of the pressure build-up zone around the wellbore at said depth region of the formations; determining, using said time, said formation pressure diffusivity and transmissibility, and said non-periodic component, the leak-off rate of the mudcake at said depth region; determining, using said leak-off rate, the pressure gradient in the formations adjacent the mudcake at said depth region; and extrapolating, using said pressure gradient and said size of the pressure build-up zone, to determine the virgin formation pressure.

In accordance with a further embodiment of the invention, a method is set forth for determining the leak-off rate of a mudcake formed, at a particular depth region, on a borehole drilled in formations using drilling mud, and on which a mudcake has formed, comprising the following steps: deriving formation permeability at the depth region; causing wellbore pressure to vary periodically in time, and measuring, at the depth region, the time varying pressure in the borehole and the time varying pressure in the formations adjacent the mudcake; determining, at the depth region, an estimate of the flow resistance of the mudcake from the derived permeability and components of the measured pressure in the borehole and the measured pressure in the formations adjacent the mudcake; and determining, at the depth region, the leak-off rate of the mudcake from the estimated flow resistance and the measured pressure in the borehole and the measured pressure in the formations adjacent the mudcake. The virgin reservoir pressure can then be obtained by: determining, at the depth region, the pressure excess in the formations adjacent the mudcake from said derived permeability, said leak-off rate, and said time since cessation of drilling; and determining, at said depth region, the virgin reservoir pressure from said measured pressure in the formations adjacent the mudcake and said pressure excess in the formations.

Further features and advantages of the invention will become more readily apparent from the following detailed description when taken in conjunction with the accompanying drawings.

BRIEF DESCRIPTION OF THE DRAWINGS

FIG. 9 is a graph illustrating wellbore storage effect on pore pressure response at the wellbore for step-wise production for different ratios of formation to storage volume characteristic times.

FIG. 10 is a flow diagram of the steps of an embodiment of the invention.

DETAILED DESCRIPTION

Figure 1:
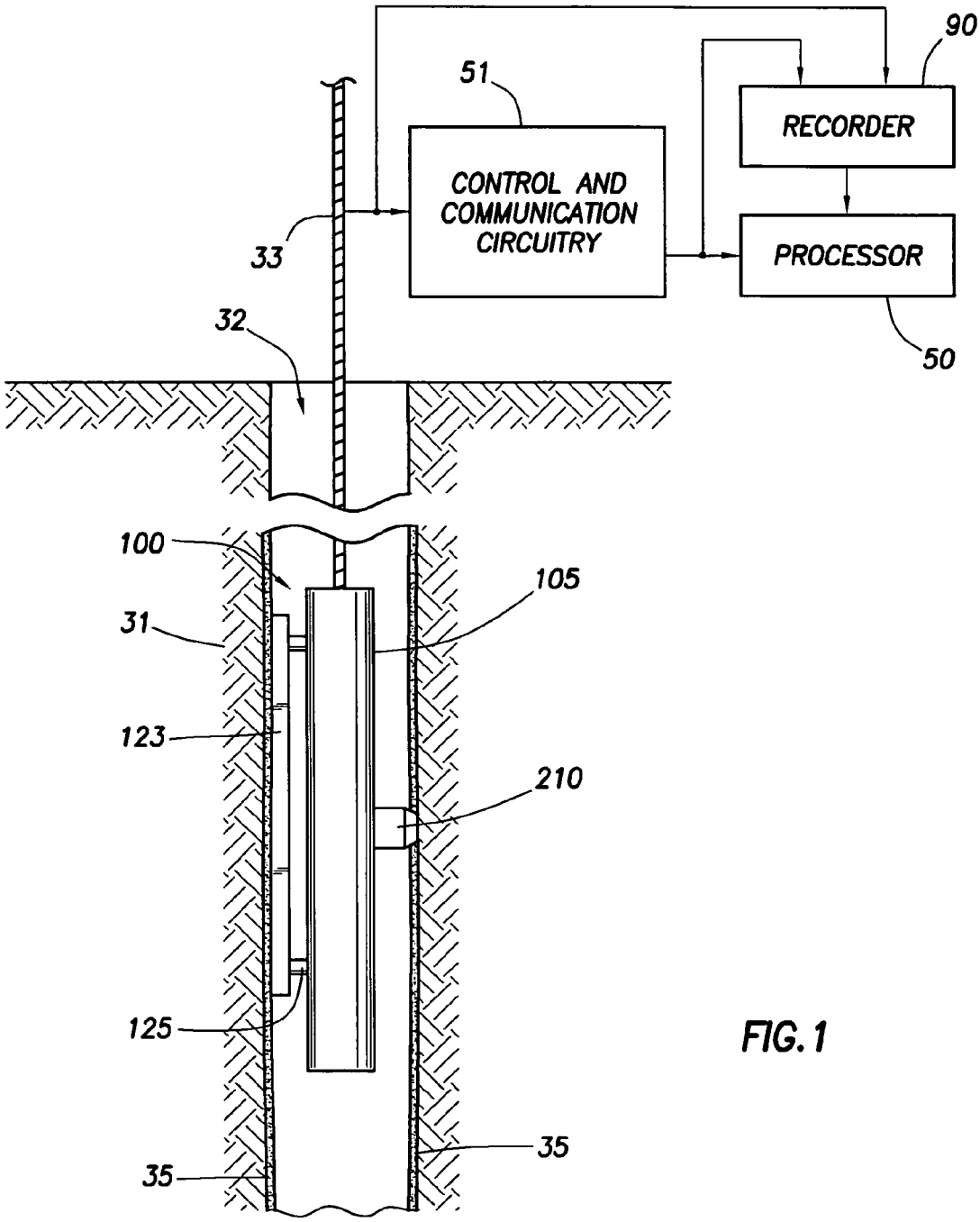
FIG. 1 is a diagram, partially in block form, of a well logging apparatus that can be used in practicing embodiments of the invention.

FIG. 1 illustrates a type of equipment that can be utilized in practicing embodiments of the invention. FIG. 1 shows the borehole 32 that has been drilled in formations 31, in known manner, with drilling equipment, and using drilling fluid or mud that has resulted in a mudcake represented at 35. For each depth region of interest, the time since cessation of drilling is kept track of, in known manner, for example by using a clock or other timing means, processor, and/or recorder. A formation tester apparatus or device 100 is suspended in the borehole 32 on an armored multiconductor cable 33, the length of which substantially determines the depth of the device 100. Known depth gauge apparatus (not shown) is provided to measure cable displacement over a sheave wheel (not shown) and thus the depth of logging device 100 in the borehole 32. Circuitry 51, shown at the surface although portions thereof may typically be downhole, represents control and communication circuitry for the investigating apparatus. Also shown at the surface are processor 50 and recorder 90. These may all generally be of known type, and include appropriate clock or other timing means.

Figure 2:
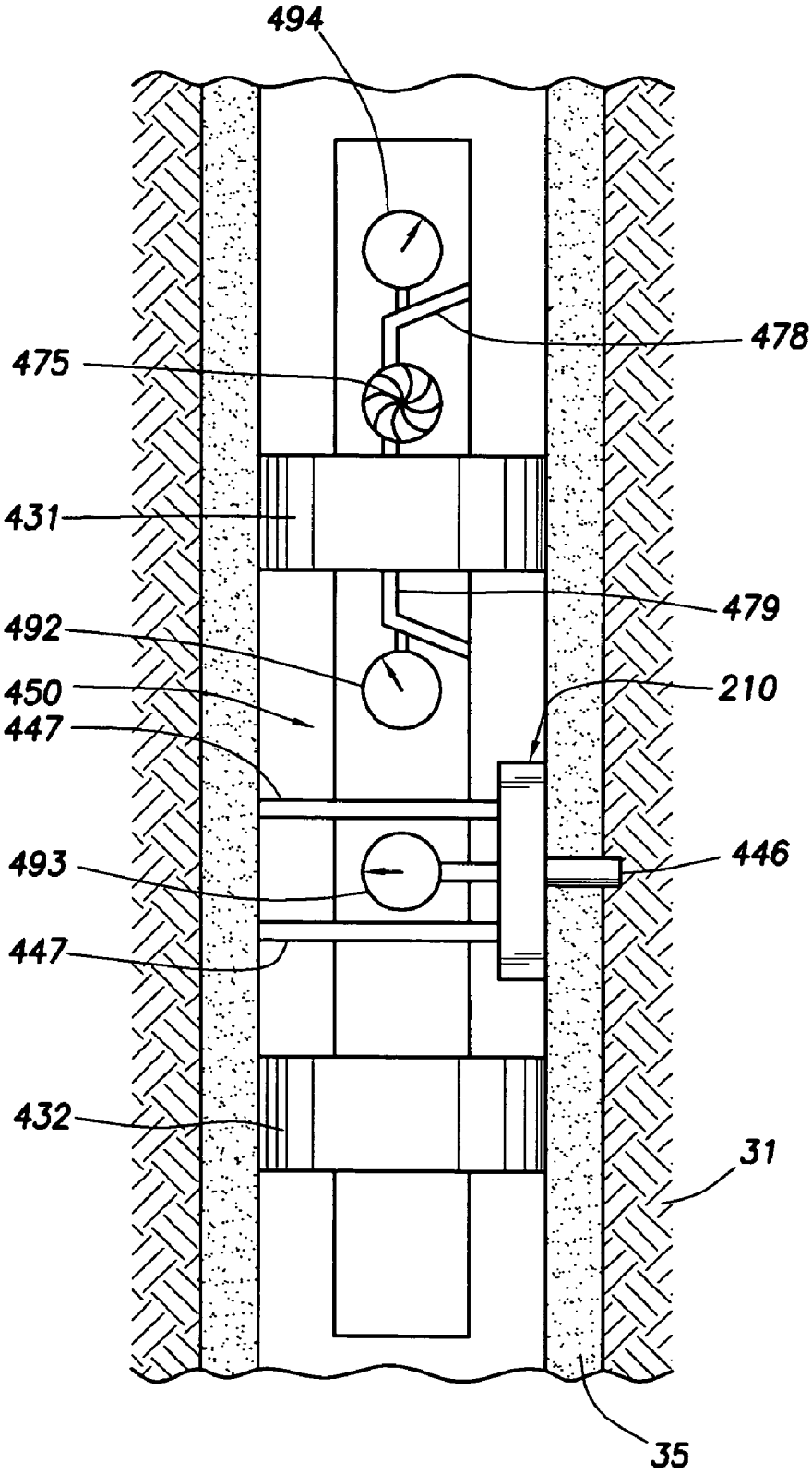
FIG. 2 is a diagram of a downhole tool which can be used in practicing embodiments of the invention.

The logging device or tool 100 has an elongated body 105 which encloses the downhole portion of the device controls, chambers, measurement means, etc. Reference can be made, for example, U.S. Pat. Nos. 3,934,468, and 4,860,581, which describe devices of suitable general type. One or more arms 123 can be mounted on pistons 125 which extend, e.g. under control from the surface, to set the tool. The logging device includes one or more probe modules that include a probe assembly 210 having a probe that is outwardly displaced into contact with the borehole wall, piercing the mudcake 35 and communicating with the formations. The equipment and methods for taking individual hydrostatic pressure measurements and/or probe pressure measurements are well known in the art, and the logging device 100 is provided with these known capabilities. Referring to FIG. 2, there is shown a portion of the well logging device 100 which can be used to practice a form of the invention wherein the variation in borehole pressure is implemented by the logging device itself (which, for purposes hereof includes any downhole equipment, wireline or otherwise) and is localized in the region where the device is positioned in the borehole at a given time. (Reference can be made to U.S. Pat. No. 5,789,669.) The device includes inflatable packers 431 and 432, which can be of a type that is known in the art, together with suitable activation means (not shown). When inflated, the packers 431 and 432 isolate the region 450 of the borehole, and the probe 446, shown with its own setting pistons 447, operates from within the isolated region and communicates with the formations adjacent the mudcake. A pump-out module 475 which can be of a known type (see, for example, U.S. Pat. No. 4,860,581), includes a pump and a valve, and the pump-out module 475 communicates via a line 478 with a borehole outside the isolated region 450, and via a line 479, through the packer 431, with the isolated region 450 of the borehole. The packers 431, 432 and the pump-out module 475 can be controlled from the surface. The borehole pressure in the isolated region is measured by pressure gauge 492, and the probe pressure is measured by the pressure gauge 493. The borehole pressure outside the isolated region can be measured by pressure gauge 494. Embodiments hereof can utilize pumping and/or suction ports in the testing phase, and it will be understood that multiple pumping and/or suction ports can be provided.

Figure 3:
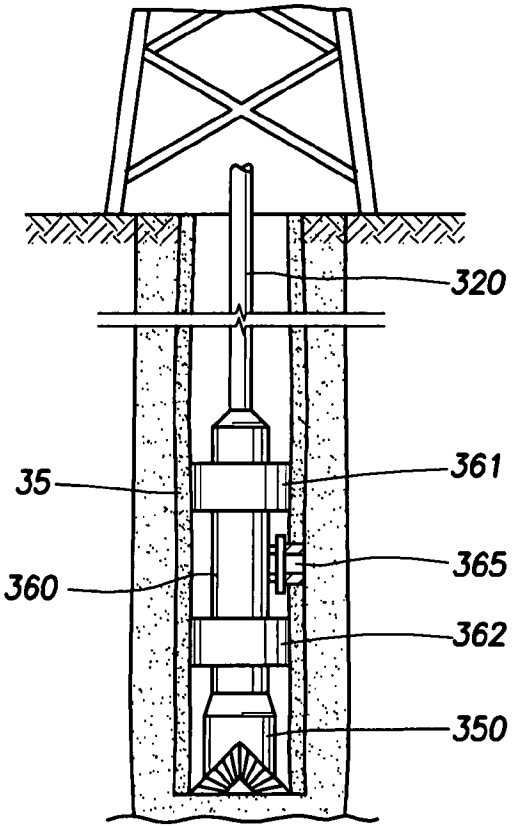
FIG. 3 is a diagram of logging-while-drilling apparatus that can be used in practicing embodiments of the invention.

Embodiments of the present invention can also be practiced using measurement-while-drilling ("MWD") equipment (which includes measuring while tripping). FIG. 3 illustrates a drilling rig that includes a drill string 320, a drill bit 350, and MWD equipment 360 that can communicate with surface equipment (not shown) by known telemetry means. Preferably, the MWD equipment is provided with packers 361 and 362. A device 365 is also shown, which includes probe(s) and measurement capabilities similar to the device described in conjunction with FIG. 2.

The pressure build-up around the wellbore in relatively low permeability formations (such as $k=10^{-1}$ mD) during drilling operations is a slow process, which usually lasts a few days and affects a relatively small neighborhood of the wellbore. The radius of the zone with elevated pressure around the wellbore can be estimated, using dimensional analysis.

Assume that Darcy's law governs the flow in the reservoir $$v = -\frac{k}{\mu}\nabla p \tag{1}$$

where v is the fluid flow velocity, μ is the fluid viscosity and p is the pore pressure, which has to satisfy the pressure diffusivity equation $$\frac{\partial p}{\partial t} = \eta\nabla^2 p,\ \eta = \frac{kB}{\phi\mu} \tag{2}$$

where t is the time, B is the bulk modulus of the rock saturated with fluid, ϕ is the porosity and η is the pressure diffusivity (see G. I Barenblatt, V. M. Entov and V. M. Ryzhik: Theory of Fluid Flows Through Natural Rocks, Dordrecht: Kluwer, 1990).

If the time of exposure of the wellbore to overbalance pressure, $t_e$, is known, then the radius of the zone with elevated pressure around it can be estimated as $$r_e \approx 2\sqrt{\eta t_e} \tag{3}$$

Using, for example, the following data: $k=10^{-3}-10^{-1}$ mD, B=1 GPa, μ=1 cp and φ=0.2, one would obtain $\eta=(5-500)\cdot 10^{-6}$ $m^2/s$. For the pressure build-up time $t_e$=1 day, one finds $$re\approx 1.3-13\ m \tag{4}$$

The depth of investigation by conventional transient pressure testing, $r_i$, also can be estimated, using the same formula (3). For example, if the investigation times are $t_i$=2 hours, 20 min and 2 min, then the ratio $r_i/r_e$ can be respectively estimated as $$r_i/r_e=\sqrt{t_i/t_e}\approx 0.29,\ 0.12,\ 0.04 \tag{5}$$

This means that only first 29%, 12%, and 4%, respectively, of the thickness of the pressure build-up zone can be sensed by the methods of transient pressure testing.

Figure 4:
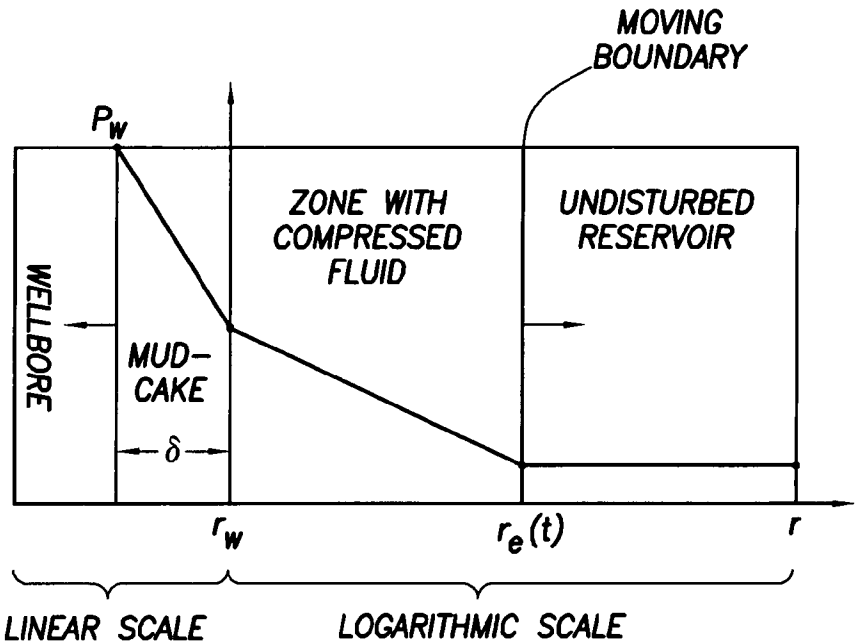
FIG. 4 is a graph of the quasi-steady pore pressure profile around the well bore.

The analysis of pressure build-up around the wellbore during drilling requires coupled consideration of the pressure wave propagation and the filter cake growth, induced by mud filtrate leak-off and usually restricted by the mud circulation inside the wellbore. If the overbalance pressure applied during drilling operations does not change dramatically, the transient pressure evolution around the wellbore can be approximated by the quasi-steady pressure behavior $$p(r,t)=\begin{cases} p_0+[p_{sf}(t)-p_0]\dfrac{\log[r_e(t)/r]}{\log[r_e(t)/r_w]}, & r_w\le r\le r_e(t) \\ p_0,\ r>r_e(t) \end{cases} \tag{6}$$

where $p_0$ is the original formation pressure, $p_{sf}(t)$ is the pressure at the sand face, $r_w$ is the wellbore radius and $r_e(t)$ is the radius of zone around the wellbore with build-up pressure. The schematic of the pore pressure profile is shown in FIG. 4. During the initial phase of wellbore exposure to overbalance, the pressure at the sand face, $p_{sf}$, is equal to the wellbore pressure, $p_w$. Then, the sand face pressure decreases with the increase in the filter cake thickness and its hydraulic resistance due to the pressure drop across the filter cake, $\Delta p=p_w-p_{sf}$.

If the filter cake permeability is small compared to that of the formation, the sand face pressure, $p_{sf}$, falls quickly to the initial formation pressure, $p_0$. If, however, the formation permeability is small and therefore the leak-off through the sand face is restricted, the filter cake is not built efficiently and the exposure of the formation to the overbalanced pressure can continue indefinitely.

The unknown functions, $p_{sf}(t)$ and $r_e(t)$, can be found from the pressure diffusivity equation (2) coupled with the model of the filter cake growth at the sand face. This analysis can be carried out for a simple model of the filter cake growth, based on the following assumptions: the porosity and permeability of filter cake are constant; the volumetric concentration of solids in the mud, filling the wellbore, is constant; the filtrate invading into the formation is fully miscible with the reservoir fluid; the filtrate viscosity is equal to that of reservoir fluid; and both spurt loss and internal filter cake formation are neglected. It is also assumed in this analysis that the filter cake permeability is much smaller than the reservoir permeability and the filter cake thickness, growing with time, is small compared to the wellbore radius. Under these assumptions, the flow through the filter cake can be considered as quasi-steady and one-dimensional at any time and therefore the pressure variation across the filter cake is linear as shown in FIG. 4.

The sand-face pressure, $p_{sf}(t)$, is affected by a lot of factors, including the reservoir hydraulic conductivity, the leak-off rate and the rate of mud circulation. It also depends on the filter cake hydraulic resistance, which varies with time. Despite this complexity, the boundary of the pressure perturbation zone, $r_e(t)$, plotted in appropriate dimensionless variables, is found to not practically depend on the filter cake growth dynamics and can be approximated by a universal function $Z_e(T)$, shown in FIG. 5, where $$Z_e(T)=Y(T)-1,\ Y=\left(\frac{r_e}{r_w}\right)^2,\ T=\frac{\eta t}{r_w^2} \tag{7}$$

Since the time of wellbore exposure to overbalance pressure, $t_e$, is usually known, the only parameter, which is needed for the estimation of the radius of zone with perturbed pressure, $r_e(t_e)$, is the pressure diffusivity, η, which is involved in the definition of the dimensionless time T.

Assume that η has been found somehow and therefore the boundary $r_e(t_e)$ $$r_e(t_e)=r_w\sqrt{Z_e\left(\frac{\eta t_e}{r_w^2}\right)+1} \tag{8}$$

Then, one has to measure the pore pressure at the sand face, $p_{sf}(t_e)$, and at an intermediate point $r=r_m$ inside the zone $r_w<r<r_e(t_e)$ in order to find the formation pressure $$p_0=\frac{p_m\log(r_e/r_w)-p_{sf}\log(r_e/r_m)}{\log(r_m/r_w)},\ p_m=p(r_m) \tag{9}$$

The sand-face pressure $p_{sf}(t_e)$ can be measured by currently available wireline testing tools and therefore, in order to obtain the formation pressure, $p_0$, one has to determine the two parameters only—the pressure diffusivity, η, and the pressure at some distance from the wellbore, $p_m$, or alternatively the pressure gradient at the sand face $$\nabla p_{sf}(t_e)\approx\frac{p_m(t_e)-p_{sf}(t_e)}{r_m-r_w} \tag{10}$$

Thus, if the formation transmissibility, kh/μ, which involves the interval thickness h, is known, the determination of the formation pressure, $p_0$, is equivalent to the determination of the quasi-steady leak-off rate, $q_L(t_e)$, at the end of the pressure build-up phase $$q_L(t_e)=\frac{2\pi hkr_w}{\mu}\nabla p_{sf}(t_e) \tag{11}$$

As shown below, $q_L$, can be determined using pulse-harmonic tests, which can be carried out with appropriately chosen testing frequencies and pumping rates.

In the following analysis of determination of far field formation pressure using pulse-harmonic testing, it is assumed that total testing time is small compared to the pressure build-up time (the time of borehole exposure to pressure overbalance); the pre-test volume is small compared to the total volume produced during testing, and the filter cake is removed during pre-test. For simplicity, variation of the pressure diffusivity and the formation transmissibility versus the distance from the wellbore are ignored.

Consider the situation just before pulse-harmonic testing, i.e. at $t=t_e$. The pressure around the wellbore, $p_e(r)=p(r,t_e)$, specifies the initial condition with respect to the testing time $\tau=t-t_e$. Using the same notation for the pressure, $p(r,\tau)$, one has $$p(r;0)=p_e(r),\ r\geqq r_w \tag{12}$$

As mentioned above, the function $p_e(r)$ is usually unknown except, its boundary value, $p_{w0}=p_e(r_w)$, which can be measured or estimated, using conventional formation testing. Using Eq. (6), the initial pressure profile around the wellbore before testing can be expressed as $$p_e(r) = p_0 + (p_{w0} - p_0)\frac{\log[r_e(t_e)/r]}{\log[r_e(t_e)/r_w]},\ r_w \leq r \leq_e (t_e) \tag{13}$$

and the corresponding quasi-steady leak-off rate from the wellbore interval of thickness h is $$q_L = \frac{2\pi kh}{\pi}\frac{p_{w0} - p_0}{\log[r_e(t_e)/r_w]} \tag{14}$$

This leak-off rate, $q_L$, is unknown in advance and its determination would be equivalent to the determination of the two parameters: the radius of the pressure build-up zone, $r_e(t_e)$ and the formation pressure, $p_0$.

Using Eq. (14), the initial pressure profile can be represented in the equivalent form $$p_e(r) = p_{w0} - \varphi_L\log\left(\frac{r}{r_w}\right),\ \varphi_L = \frac{q_L\mu}{2\pi kh} \tag{15}$$

Generally speaking, the parameter $\phi_L$ could be determined, using, for example, the conventional pressure build-up technique, if one could seal instantaneously the sand face of the wellbore interval and monitor the pressure relaxation, $p_w(\tau)$, behind the sand face with time. Indeed, due to the superposition principle, the pressure response at the sealed sand face to the step-wise variation of the flow rate can be expressed as $$\Psi_w(\tau)=p_w(\tau)-p_{w0}=-\phi_L F_0(\eta\tau/r_w^2) \tag{16}$$

Figure 6:
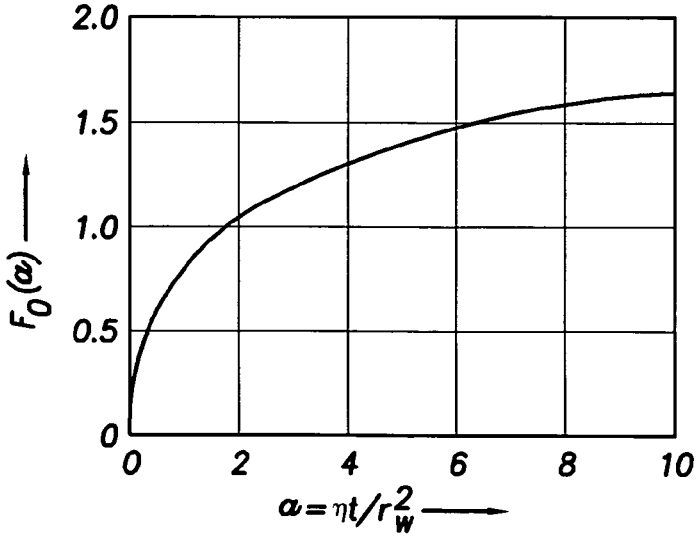
FIG. 6 is a graph of formation response at the sand face.

Here, the function $F_0(a)$, where $a=\eta\tau/r_w^2$, is given by the well-known solution of the pressure diffusivity equation (see, for example, H. S. Carslaw and J. C. Jaeger: Conduction of Heat in Solids, 2nd Edition, Oxford: Clarendon Press, 1959)

$$F_0(a) = \frac{4a}{\pi^2}\int_0^\infty \frac{\left(1-e^{-\zeta^2}\right)d\zeta}{\zeta^3\left[J_1^2\left(a^{-\frac{1}{2}}\xi\right)+Y_1^2\left(a^{-\frac{1}{2}}\xi\right)\right]} \tag{17}$$

where the $J_i$ and $Y_i$ are Bessel functions of the first and second kind, respectively, of order i, i=0, 1, and it is shown in FIG. 6, reproduced from Carslaw et al., supra. Since, at large time $$\psi_w(\tau) \approx -\varphi_L\log\left(\frac{2.25\eta\tau}{r_w^2}\right) \tag{18}$$

one could determine the two parameters, $\phi_L$ and $\eta/r_w^2$, by plotting $\Psi_w(\tau)$ versus log $\tau$.

This straightforward approach, which is widely used in the well testing technology (see T. D. Streltsova: Well Testing in Heterogeneous Formations, Exxon Monograph, John Wiley and Sons, 1988), is, however, rather difficult to implement in reality. There are a few reasons for this. First of all, the necessary testing time in low permeability formations is usually extensive. Secondly, the initial leak-off rate in a low permeability formation is typically very small and can be very difficult to measure. The sealing of the sandface and the pressure monitoring is preferably done with great care so as not to disturb the formation and the pressure at the sandface. It is worth noting also that the sealing of the wellbore surface could be replaced by the pressure relaxation procedure, which would prevent the leak-off, but this is not much easier to implement because the detection of a very small leak-off can be even more challenging. Thus, a different type of pressure testing procedure is needed. Pulse-harmonic testing has the advantage of not compromising the accuracy of measurements and the amount of information to be extracted from the data is comparable to that, which maybe extracted by conventional means.

Consider the pressure evolution around the wellbore during pulse-harmonic testing with a production rate $q_w(\tau)$, having a period $\overline{T}$. Using the superposition principle, one can represent the production rate perturbation during testing, $q(\tau)=q_w(\tau)+q_L$, as a sum of its periodic component with zero average rate, $q_p(\tau)$, and the constant average rate, $q_a$, i.e.

$$q(\tau)=q_p(\tau)+q_a,\ q_a=\overline{q}_w+q_L,\ q_p(\tau)=q_w(\tau)-\overline{q}_w \tag{19}$$

where $$\overline{q}_w = \frac{1}{\overline{T}}\int_0^{\overline{T}} q_w(\tau)\,d\tau \tag{20}$$

Figure 8:
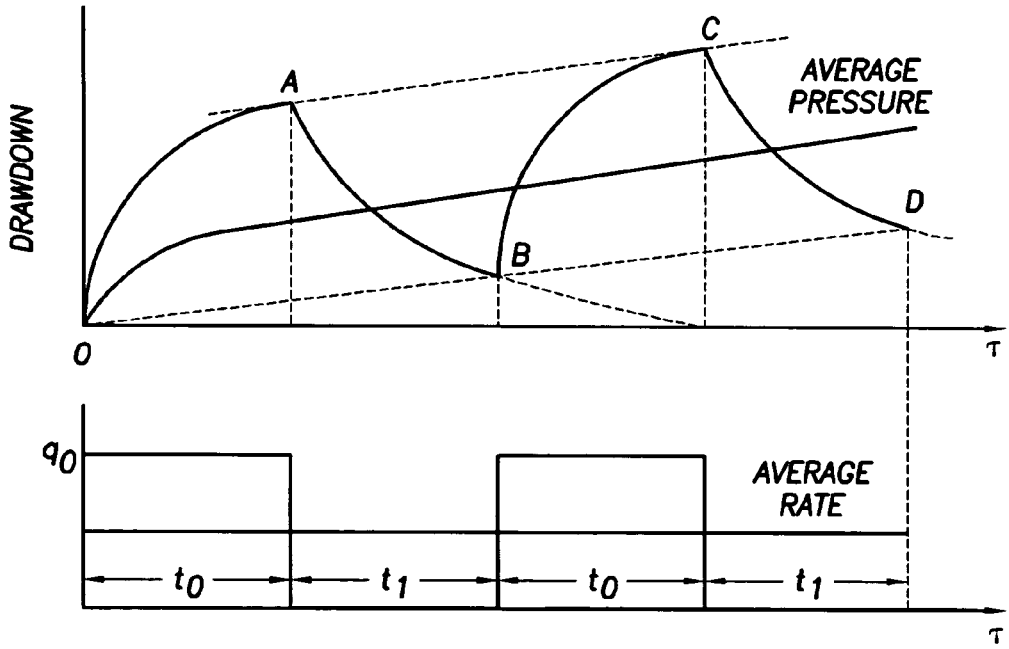
FIG. 8 is a graph showing pressure response at the wellbore to multiple-pulse production.

The unknown leak-off rate, $q_L$, has been added to the production rate $q_w(\tau)$ to compensate for the initial non-uniform pressure profile (15) around the wellbore. The advantage of this testing procedure is that the periodic part, $q_p(\tau)$, can be tuned for different depths of investigation, $R\approx 2\pi\eta\overline{T}$, by changing the angular frequency $\omega=2\pi/\overline{T}$ (see Stretsolva, supra). The testing time is comparable with the period $\overline{T}$ and is usually much shorter than the duration of a pressure build-up after shut-in. At the same time, the average rate, $\overline{q}_w$, should not depend too much on the characteristics of the hardware (pumps, pressure gauges, flow meters). It can be tuned by choosing, for example, appropriate amplitudes, $q_0$, and durations, $t_0$, of production pulses and the ratio $t_0/\overline{T}$ (FIG. 8). The interpretation of the responses to the periodic component, $q_p(\tau)$, and non-periodic component, $q_a$, of the production rate then can be carried out independently.

The other advantage of this superposition is that the periodic component, $q_p(\tau)$, does not involve the unknown initial leak-off rate, $q_L$, and the extraction of the pressure response to the periodic rate $q_p(\tau)$, from the measured pressure variation at the wellbore, $\Psi_w(\tau)$, is a standard task in the practice of pulse-harmonic testing (see Streltsova, supra). Processing the pressure response to the periodic component, allows one to determine the pressure diffusivity, $\eta$, and the formation transmissibility, $kh/\mu$. This reduces the number of unknown parameters in the presentation of the initial pressure profile before testing, determined by Eqs. (13) and (8), to only one—the formation pressure, $p_0$.

The determination of $p_0$ requires the processing of the wellbore pressure response to the non-periodic component of the production rate, which is represented by the average constant rate, $q_a$. Using the superposition principle, this response can be expressed similarly to (16) as $$\psi_a(\tau) = -(\overline{\varphi_w} + \overline{\varphi_L})F_0(\eta\tau/r_w^2),\ \overline{\varphi_w} = \frac{\overline{q_w}\mu}{2\pi kh},\ \varphi_L\frac{q_L\mu}{2\pi kh} \tag{21}$$

Here, $\Psi_a(\tau)$ is the measured pressure response minus the periodic component; the parameter $\overline{\phi}_w$ is already known, and the parameter $\phi_L$ is still unknown.

The function $F_0(a)$ is defined by (17) and shown in FIG. 6. Since the pressure diffusivity, $\eta$, has already been determined from the pressure response to the periodic component, the argument $a=\eta\tau/r_w^2$ can be calculated. Now, compare Eq. (16) and Eq. (21). Eq. (16), which corresponds to the standard pressure build-up test, involves two unknowns, $\phi_L$ and $\eta$, whereas Eq. (21) involves only a single unknown parameter, $\phi_L$. This advantage can be exploited to full extent. Indeed, the parameter $\phi_L$ can be estimated, using the pulse-harmonic testing data, as $$\varphi_L = -\overline{\varphi}_w - \frac{\psi_a(\tau)}{F_o(\eta\tau/r_\omega^2)} \tag{22}$$

Thus, the last term in the right-hand side of Eq. (22), which formally depends on the testing time $\tau$, has actually to be constant. This term can be estimated, using the pressure measurements in the wellbore, $\Psi_a(\tau)$, and the function $F_0(a)$, representing the dimensionless reservoir pressure response to an average step-wise production rate.

After the determination of the parameter $\phi_L$, the desired formation pressure can be estimated as $$p_0=p_{w0}-\phi_L \log[r_e(t_e)/r_w] \tag{23}$$

Figure 7:
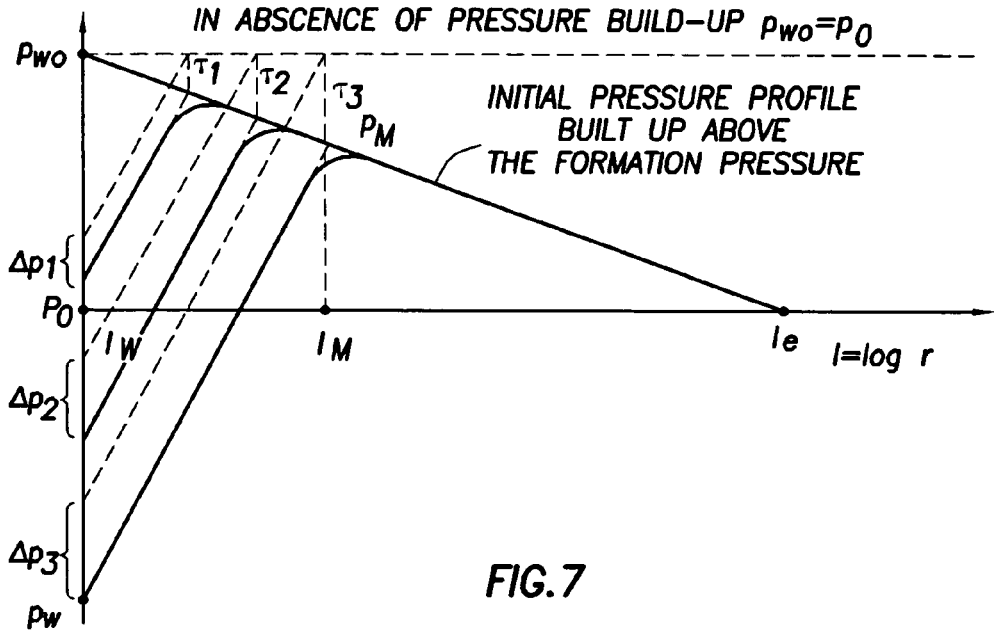
FIG. 7 is a diagram of average pore pressure around a wellbore during pulse testing. Solid lines are shown, in the presence of pressure build-up; dashed lines, without build-up.

Eq. (22) can be also interpreted as follows. In the absence of the initial pressure build-up and the corresponding leak-off rate, the last term in its right-hand side has to be equal exactly to $\overline{\phi}_w$. This means that the difference between the two terms at $q_L\neq 0$ represents the effect of the "boundary condition" at the virtual moving boundary, corresponding to the pressure wave, propagating into the formation, as shown in FIG. 7. Here, the pressure profiles are plotted in the logarithmic scale $l=\log r$ for three sequential testing times $\tau_1<\tau_2<\tau_3$. Since the average production rate is constant, the solid lines, representing the pressure profiles in presence of the initial pressure build-up, $p_{w0}-p_0$, have the same slopes. The dashed lines represent the pressure profiles, which should be observed in the absence of the initial pressure build-up. It is assumed also that the velocity of the virtual front of the pressure wave, $l=l_M$, propagating into the formation, is not affected by the pressure build-up. For this reason, the difference between the wellbore pressure behavior in the two cases is accumulated with time: $\Delta p_1<\Delta p_2<\Delta p_3$. This accumulated difference makes the term $-\Psi_a(\tau)=p_{w0}-p_w(\tau)$ involved in Eq. (22), larger than the denominator $F_0(\eta\tau/r_w^2)$, which represents the response to the step-wise rate, $\overline{\phi}_w$, corresponding to the uniform initial pressure profile.

In the following example, consider the multiple-pulse testing procedure, illustrated in FIG. 8, with the production pulse amplitude $q_0$, the production pulse duration $t_0$, the period $\overline{T}$ and the time lag between two sequential pulses $t_1=\overline{T}-t_0$. The average production rate, $\overline{q}_w$, can be found from (20) as $$\overline{q}_w=q_0(t_0/\overline{T}) \tag{24}$$

Using the superposition principle, the pressure response to the first production pulse at the wellbore can be represented as $$\Psi_w(\tau)=-\overline{\phi}_w[F_0(a)-\theta(\tau-t_0)F_0(a_1)] \tag{25}$$

where $\theta(\tau)$ is the Heaviside unit step function and $$\overline{\varphi}_\omega = \frac{q_o\mu}{2\pi kh}\left(\frac{t_o}{\overline{T}}\right),\ a = \frac{\eta\tau}{r_\omega^2},\ a_1 = \frac{\eta(\tau - t_o)}{r_\omega^2} \tag{26}$$

Using the measurements of the pressure perturbation at the first shut-in (the point A in FIG. 8) and at the beginning of the second production period (the point B), $\Psi_A$ and $\Psi_B$, the equation for the pressure diffusivity $\eta$ can be obtained $$\frac{\psi_A}{\psi_B} = \frac{F_o(\eta t_o/r_\omega^2)}{F_o(\eta\overline{T}/r_\omega^2) - F_o(\eta t_1/r_\omega^2)} \tag{27}$$

After $\eta$ has been found, the formation transmissibility can be calculated as $$\frac{kh}{\mu} = \frac{q_o}{2\pi\psi_A}\left(\frac{t_o}{\overline{T}}\right)F_o\left(\frac{\eta t_o}{r_\omega^2}\right) \tag{28}$$

Figure 5:
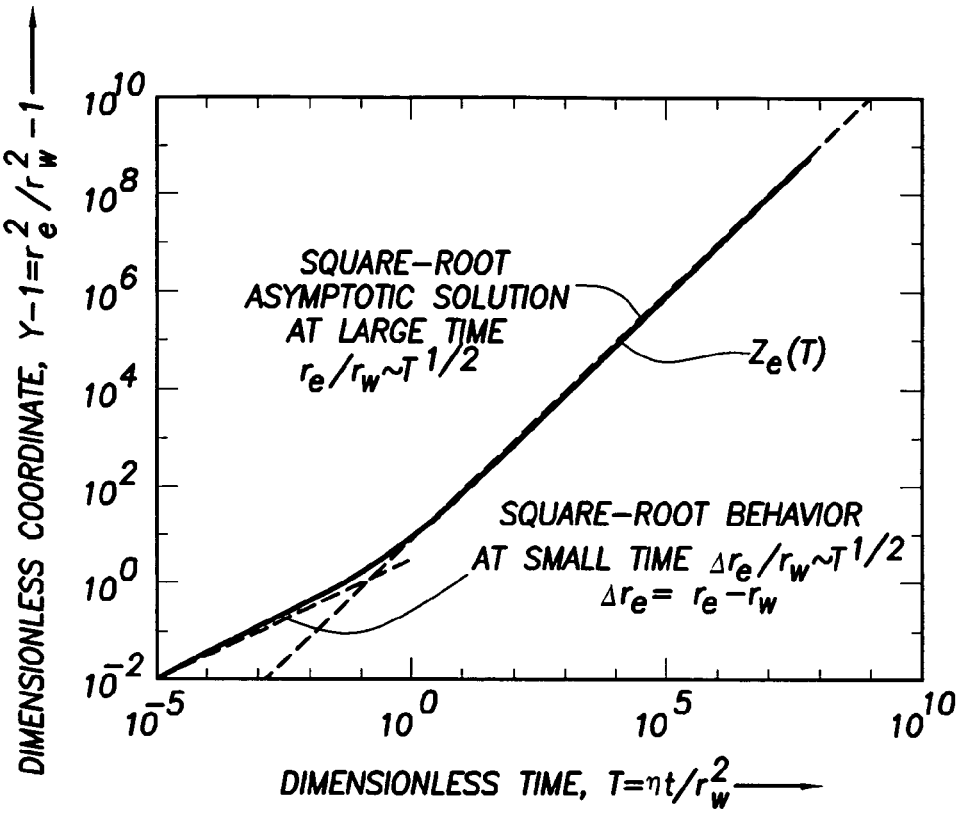
FIG. 5 is a graph of dimensionless depth of pressure wave propagation into the reservoir.

Now, the pressure response at the wellbore to the non-periodic rate, $\Psi_a(\tau)$, has to be extracted from the measured pressure curve 0ABCD . . . as shown in FIG. 8. This means that at least the first three production pulses preferably should be involved in interpretation to allow the determination of $\Psi_a(\tau)$ with confidence. Finally, the parameter $\phi_L$, which is proportional to the initial leak-off rate $q_L$, can be found, using Eq. (22), and then the formation pressure is calculated from Eq. (23)

$$p_o = p_{\omega o} - \varphi_L\log\left[\frac{r_e(t_e)}{r_\omega}\right],\ r_e(t_e) = r_w\sqrt{Z_e\left(\frac{\eta t_e}{r_w^2}\right)+1} \tag{29}$$

where the function $Z_e(T)$ is shown in FIG. 5.

The graphical interpretation in FIG. 7 aids in the understanding of the requirements of the pulse testing design, which should reduce possible interpretation errors. It is obvious that the average production rate $q_0(t_0/T)$ should not be too high compared to the leak-off rate, otherwise the right-hand side of Eq. (22) will be small compared to the terms involved in their residual and therefore errors of their measurements may affect the accuracy of calculation of $\phi_L$. The best resolution should be achieved when $q_0(t_0/T)$ is close to the leak-off rate. In this case, the slopes of the local transient pressure profiles and the build-up pressure profile are equal but have opposite signs.

The fluid volume, located between the pump and the wellbore surface (or sand face), which is known also as a storage volume, can distort the production pulses created at the pump. As a result of this distortion, the boundary condition at the wellbore surface does not match exactly the production schedule, generated by the pump, and therefore the pressure response is different from the obtained solution. This phenomenon, known as a wellbore (or tool) storage effect, can be important if the storage volume is large compared to the total production volume per testing cycle. Indeed, the storage volume is decompressed during production and pressurized during injection cycles, damping the rate variation, induced by the pump, and therefore smoothing the formation response to it. If the compressibility of the fluid in the storage volume is constant, the storage effect can be investigated, using the Laplace transformation technique (see Barenblatt et al., supra, and Carslaw et al., supra).

The fundamental solution for the step-wise production rate with amplitude $q_0$ and zero initial conditions is given (Carslaw et al., supra) by the formulae $$\varphi(r,\tau)=\varphi_o F_S(a),\ a=\frac{\eta t}{r_w^2},\ \varphi_o=\frac{q_o\mu}{2\pi kh} \tag{30}$$

$$F_S(a)=\frac{4a}{\pi^2}\int_o^\infty \frac{\left(1-e^{-\xi^2}\right)d\xi}{\xi^3\left[u^2\left(a^{-\frac{1}{2}}\xi\right)+v^2\left(a^{-\frac{1}{2}}\xi\right)\right]} \tag{31}$$

$$u(z)=\gamma z J_0(z)-J_1(z),\ v(z)=\gamma z Y_0(z)-Y_1(z) \tag{32}$$

It involves the additional dimensionless parameter $\gamma$, which is determined as $$\gamma=\frac{\tau_S}{\tau_F},\ \tau_S=\frac{c_o V_S\mu}{2\pi kh},\ \tau_F=\frac{r_w^2}{\eta} \tag{33}$$

which is the ratio of the two characteristic times, $\tau_S$ and $\tau_F$, corresponding to the storage volume and the formation respectively. Here, $V_S$ is the storage volume and $c_0$ is the fluid compressibility, which correlates the variation of the storage volume, $\Delta V_S$, with the pressure variation, $\Delta p$, as $\Delta V_S=-c_0 V_S \Delta P$. The solution (31)–(32) becomes identical to (17) at $\gamma=0$. The function $(2\pi)^{-1}F_S(a)$ versus $\log_{10}(a)$ for $\gamma^{-1}=0.5$, 1, 2, 4 and $\infty$ is shown in FIG. 9 (reproduced from Carslaw et al.). One can see that the storage effect is more pronounced at small time, especially for large $\gamma$. This solution can be used for the interpretation of the pulse testing data as outlined above instead of the solution (16)–(17).

It will be understood that the described technique can be expanded to take into account the variation of the formation properties, i.e. the pressure diffusivity and transmissibility, with the distance from the wellbore due to invasion of mud filtrate into the formation during drilling. Pulse-harmonic testing with different frequencies can be used to discriminate the responses of the damaged zone and the undamaged formation. The design of the testing procedure in such a case would require some a priori information (at least, an order of magnitude estimate) about the formation transmissibility and diffusivity. If they vary significantly with distance from the wellbore, the interpretation of the pressure response to a non-periodic component of the production rate would need to be modified, and a longer testing time would generally be necessary.

FIG. 10 is a flow diagram of steps for practicing an embodiment of the invention, as described. The block 1003 represents keeping track of the time since cessation of drilling at the depth region(s) of interest. A pretest is performed (block 1005) and downhole parameters, including permeability, are measured in conventional fashion (block 1010). Borehole pressure in the zone is increased (block 1020), and oscillated flow rate (block 1030). As discussed, the pressure can be controlled, for example, from the wellhead or between the dual packers. A first set of downhole parameters is determined (block 1040). In the present embodiment, this includes determining, using the periodic component of the measured pressure, the formation pressure diffusivity and transmissibility, and an estimate of the size of the pressure build-up zone around the wellbore. Then, as described, this set of downhole parameters, and the non-periodic component of the measured pressure, are used to determine the filtrate leak-off rate and/or the pressure gradient (block 1060). The formation pressure can then be determined by extrapolation (block 1075).

Figure 11:
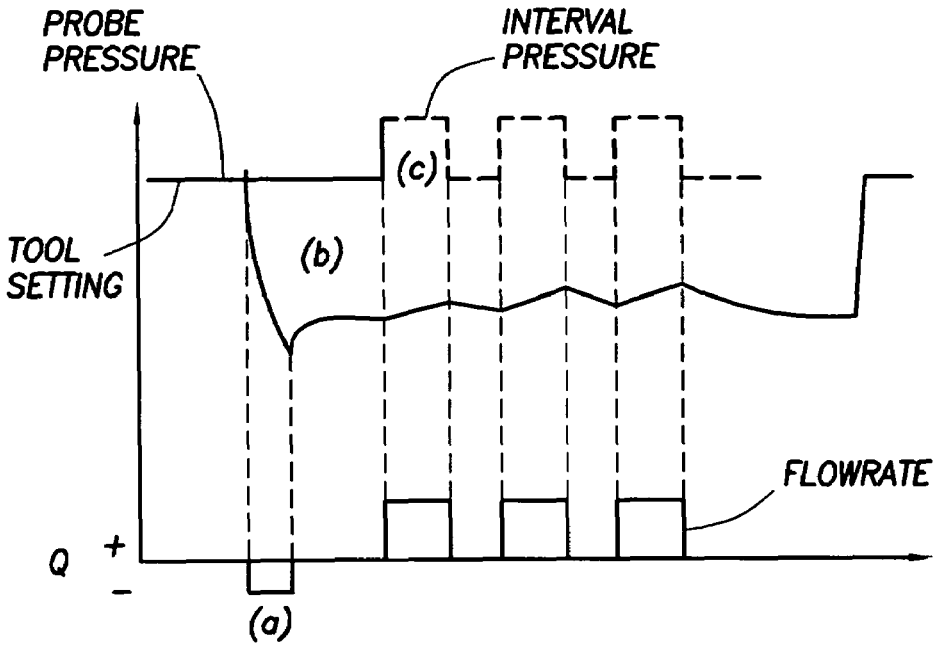
FIGS. 11 and 12 illustrate, respectively, testing in a pumping injection mode and in a production mode.
Figure 12:
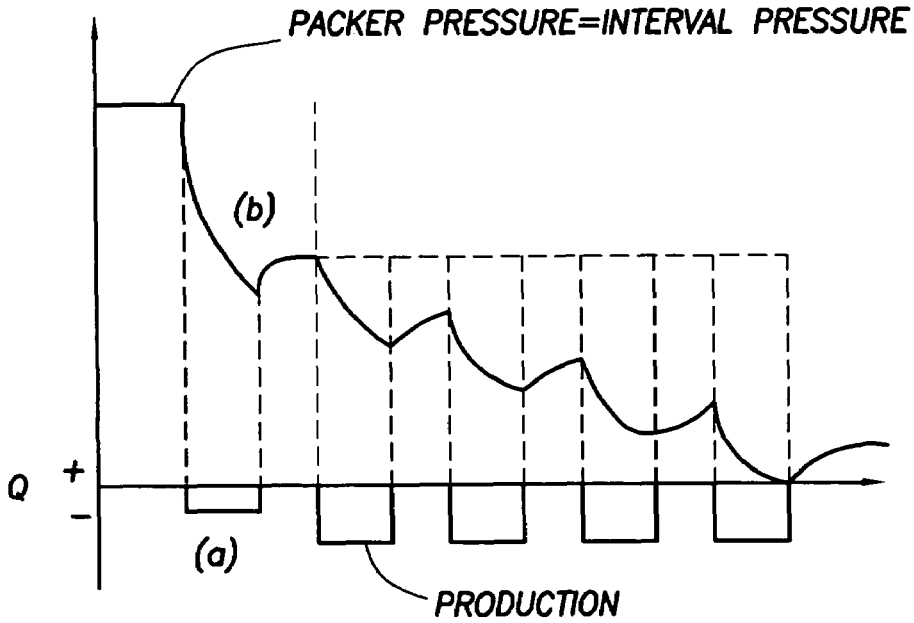

FIGS. 11 and 12 illustrate testing in a pumping/injection mode (FIG. 11) and a production mode (FIG. 12).

For the pumping/injection mode of FIG. 11, a primary purpose is measurement of the hydraulic conductivity of the mudcake, which should not be significantly damaged, removed or modified if fluid is pumped through it into the formation. The packed off interval may be used to: a) reduce the effects of tool storage, b) selectively isolate a specific depth region for testing and/or c) to increase the surface area and to maintain an appropriate injection rate that will induce measurable pressure response behind the mudcake without formation fracturing, among others. In FIG. 11, the time scale starts from the tool setting and probe penetration through the mudcake followed by the small volume pretest (shown at (a)) in order to cleanup the probe-formation interface and to establish good hydraulic communication between the pressure gauge (e.g. 493 in FIG. 2) and the formation sand face. After pressure build-up (shown at (b)), the fluid is injected into the formation through the packed off interval covered by mudcake using pulses (shown at (c)), creating transient pressure response behind the mudcake. The pressure at the sand face measured with the probe increases during injection pulses and relaxes between them, whereas the interval pressure is maintained constant during injections. The two pressures measured by gauges 492 (interval) and 493 (probe) allow for the calculation of the mudcake hydraulic conductivity, as described below. It is possible, using known methods to determine the diffusivity and the storativity respectively by employing low frequency and relatively high frequencies.

For testing in a production mode, as illustrated in FIG. 12, the purposes include: (1) determining formation parameters (the pressure diffusivity and the pressure transmissibility or $kh/\mu$) using the periodic pressure response at the sand face to production pulses, and then (2) estimating the initial leak-off rate from the wellbore into the formation using the non-periodic pressure response. The analysis has been set forth in detail above. As shown in the FIG. 12, the pre-test (a) is performed for mudcake cleanup and establishing good hydraulic communication between the tool and formation, followed by a few production pulses. The number of production pulses is preferably at least three. More pulses will tend to increase the resolution of the non-periodic part of the pressure response.

Figure 13A:
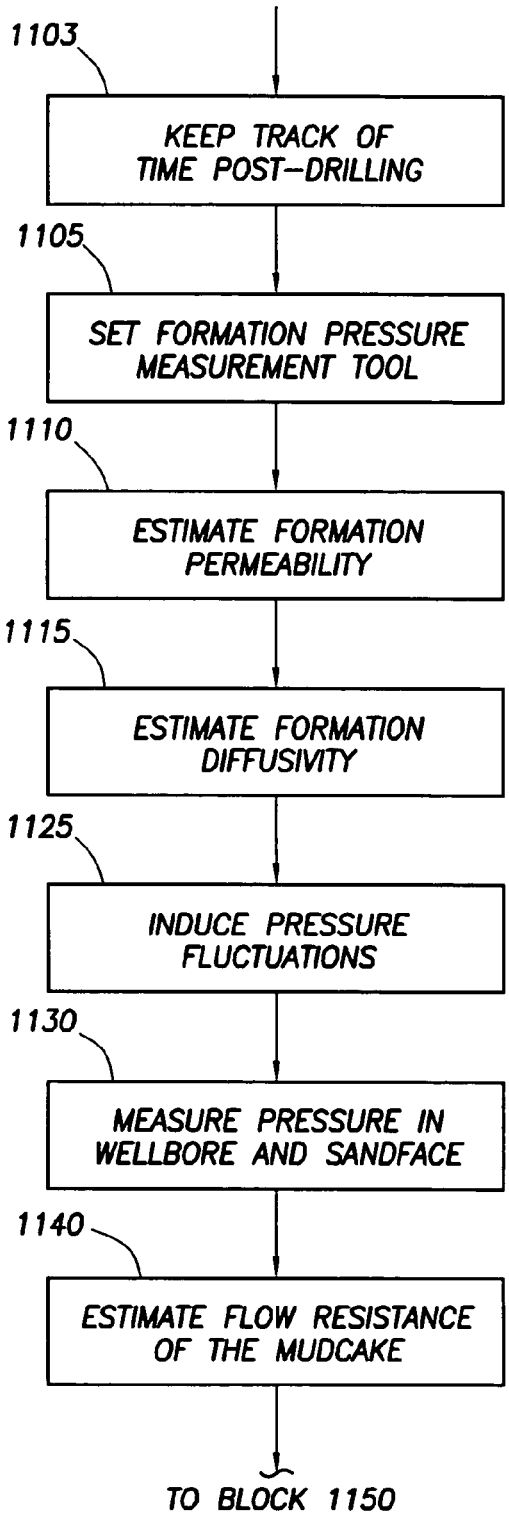
FIG. 13, which includes FIGS. 13A and 13B placed one below another, is a flow diagram of the steps of a further embodiment of the invention.
Figure 13B:
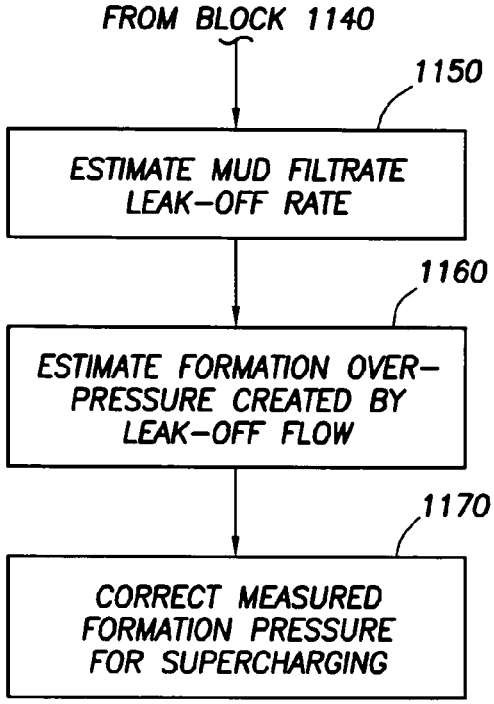

A further embodiment of the invention will next be described, this embodiment including a technique for estimating the parameters of the mudcake which control filtrate leak-off rate, and for using this estimate in turn to estimate the true reservoir pressure from the measured sandface value. A flow diagram of the steps for practicing this embodiment is shown in FIG. 13.

The time post-drilling is kept track of (block 1103). As represented by block 1105, a formation pressure measurement tool is deployed in the well, and set on the formation of interest. An estimate of the formation permeability is made (block 1110). This can be done using standard means; for example, interpretation of pre-test pressure transients. This is combined with an estimate of the formation total compressibility, to obtain an estimate of the formation pressure diffusivity (block 1115). The wellbore pressure is caused to vary periodically in time (block 1125) with significant frequency content in an appropriate frequency range, as discussed above, and treated further below. The time-varying pressures measured by the formation probe pressure sensor, and a pressure sensor in the wellbore (FIG. 2), are measured and recorded (block 1130). The time-periodic parts of the wellbore and formation pressure measurements are analyzed, using also the information on the formation permeability obtained from the pre-test, so as to give an estimate of the flow resistance of the mudcake (block 1140).

The estimated flow resistance of the mudcake is then combined with the measured wellbore and sandface pressures to estimate the filtrate leak-off rate (block 1150). Then, as represented by the block 1160, the filtrate leak-off rate is combined with the estimated formation permeability and the time of exposure of the formation post-drilling, to estimate the pressure excess at the sandface due to leak-off (i.e. supercharging). This pressure excess is subtracted from the measured pressure, to yield an estimate of the true reservoir pressure uncontaminated by supercharging (block 1170).

Further detail of the routine for this embodiment will next be described. Regarding step 1125, once the tool's probe is set and in pressure communication with the formation, steps are taken to induce modest amplitude, time periodic, absolute pressure variations within the wellbore, so as to create (a) measurable pressure disturbance within the wellbore at the tool, and (b) a measurable response to this disturbance, as seen by the pressure sensor in communication with the formation through the probe (e.g. FIG. 2).

Figure 14:
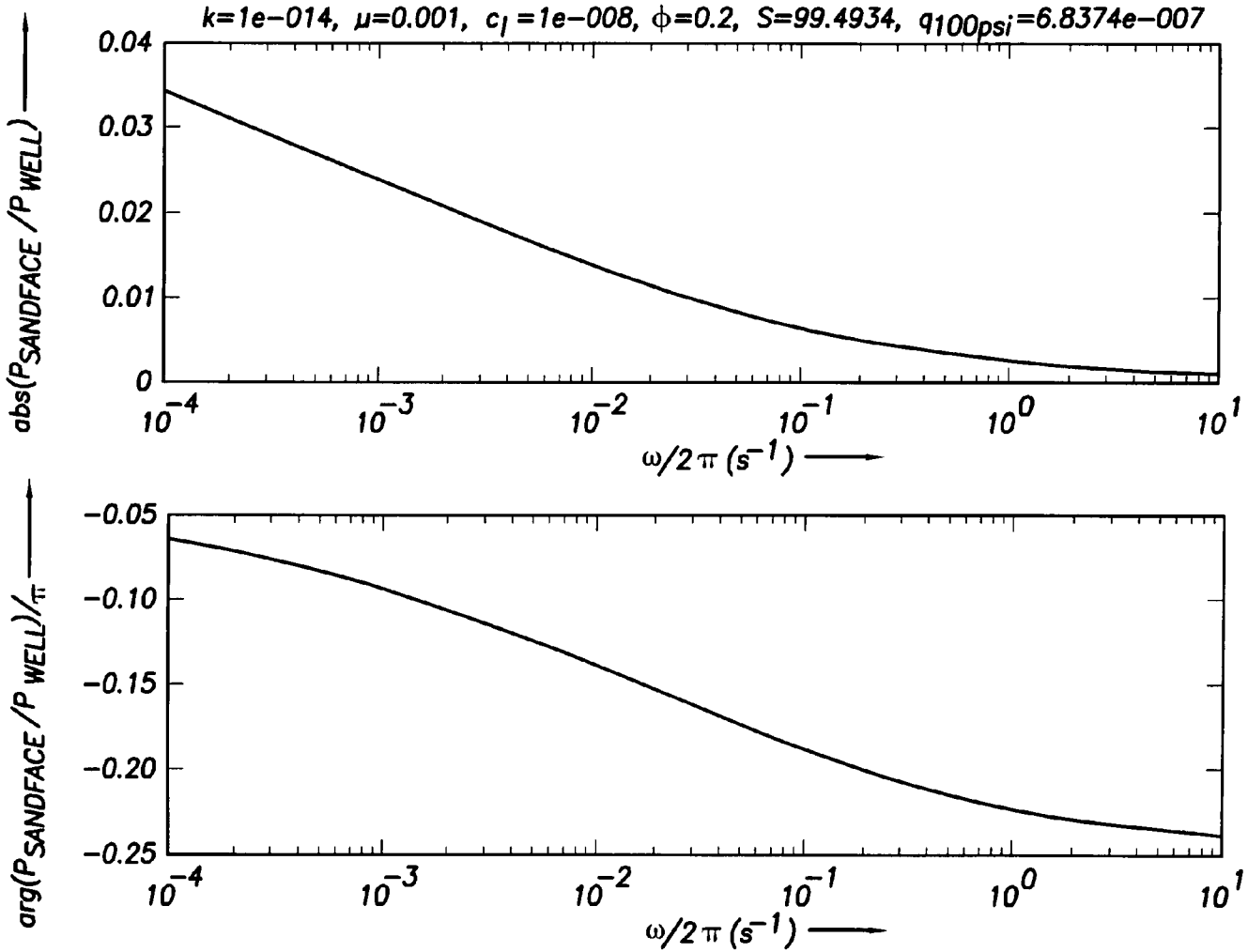
FIG. 14 shows graphs of the modulus (top track) and argument (bottom track) of the complex transfer function linking formation pressure at the sandface to wellbore pressure, plotted against frequency (in Hz).
Figure 15:
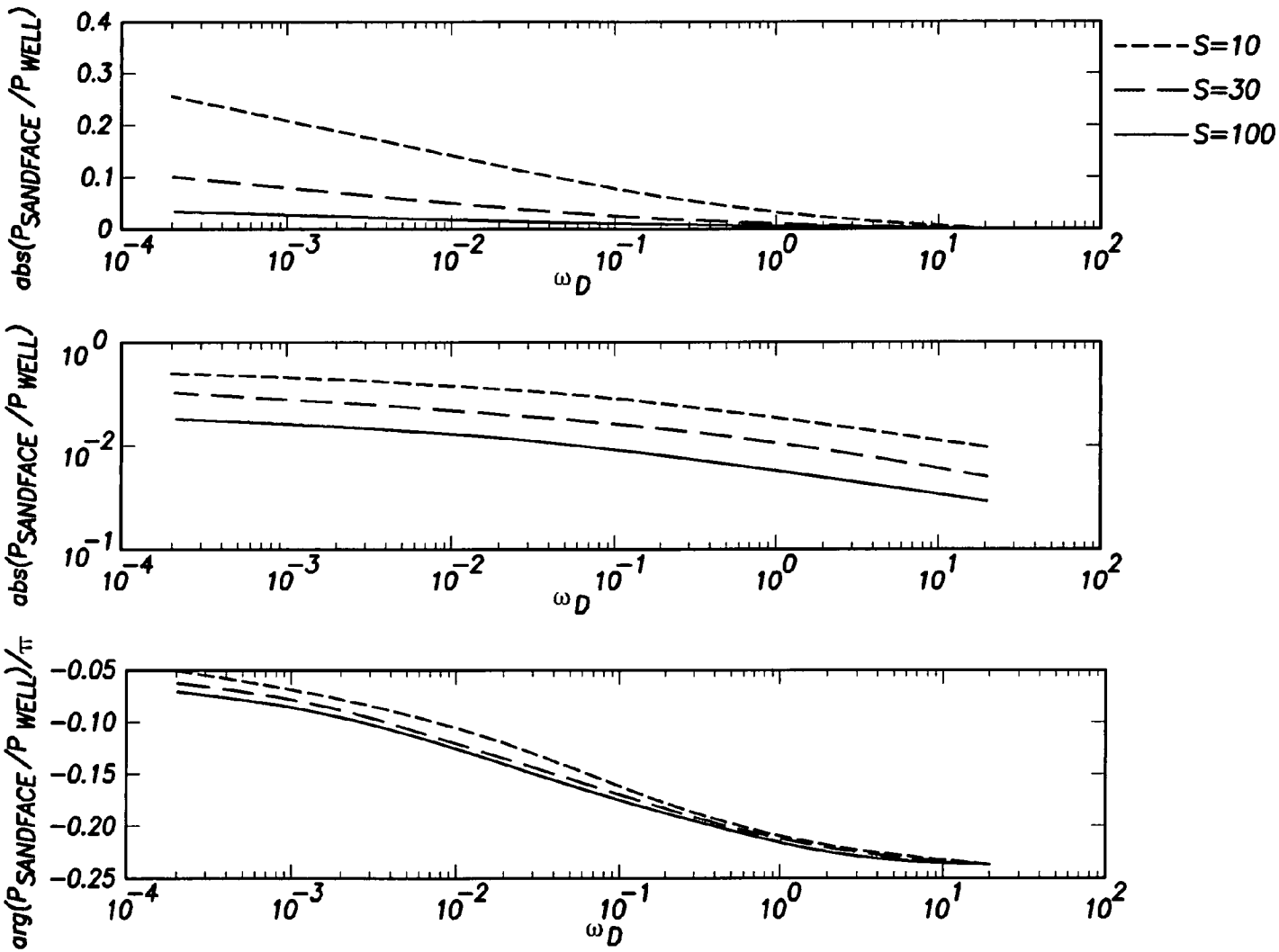
FIG. 15 shows graphs of the modulus (top two tracks) and argument (bottom track) of the complex transfer function linking formation sandface pressure to wellbore pressure, as a function of dimensionless frequency $\omega_D=\omega r_w^2/\kappa$, for a variety of values of mudcake skin. The upper two tracks repeat the same information, against linear and logarithmic y-axes.

The wellbore pressure can be written as $p_w(t)=\bar{p}_w+\Re(\hat{p}_w(\omega)e^{i\omega t})$, where $\bar{p}_w$ denotes the (constant) background wellbore pressure about which the fluctuations take place, $\Re(.)$ indicate the "real part" of argument, $\hat{p}_w$ denotes the amplitude of the oscillation, $\omega$ is the frequency. Mechanisms for generation of pressure variations within the formation include the response to changing filtrate loss rates through the mudcake (although other processes could contribute, e.g. elastic deformations of the rock or deformation of the mudcake itself). The frequency of the wellbore pressure fluctuations should be chosen so that the measured attenuation of pressure fluctuations across the mudcake is adequately sensitive to the flow resistance of the mudcake. Computed pressure responses are shown in FIGS. 14 and 15, and inspection of these indicates that a good choice of frequency is in the range $\omega_D=\omega r_w^2/\eta=O(10^{-2}$ to $10^0)$, because responses are not too small, nor dimensional frequencies too low ($r_w$ is the wellbore radius measured on the rock side of the mudcake, $\eta$ is the diffusivity of pressure within the formation, and $\omega$ is the angular frequency of the induce pressure pulsations). Selection of frequency was treated above. A further consideration in selection of frequency is that it should be low enough that the depth of penetration of pressure disturbances is greater than the thickness of the mudcake, and this translates into the requirement that $\phi_c\mu c_c\omega d^2/k_c<<1$, where d is the mudcake thickness, $c_c$ is the mudcake compressibility, $\phi_c$ is the mudcake porosity, $k_c$ is the mudcake permeability and $k_c/\phi_c\mu c_c$ is a measure of the diffusivity of pressure within the mudcake.

Regarding interpretation of attenuation of pressure fluctuations for the mudcake skin, the complex amplitude of axisymmetrical time harmonic pressure fluctuations within the formation, having angular frequency $\omega$, satisfies $$i\omega\hat{p}=\frac{1}{r}\frac{d}{dr}\left(r\frac{d\hat{p}}{dr}\right), \tag{34}$$

where actual pressures are given by $p(r,t)=\Re(\hat{p}(r,\omega)e^{i\omega t})$, $\eta=k/\phi\mu c_t$, where k is the formation permeability, $\phi$ the formation porosity, $\mu$ the viscosity of the fluid in the pore space and $c_t$ the compressibility of the fluid-solid system (formation saturated with fluid). Pressure fluctuations decay at great distances, so $\hat{p}(r,\omega)\rightarrow 0$ as $r\rightarrow\infty$. At the wellbore wall, the mudcake is modeled as an infinitesimally thin "skin", across which there is a pressure loss proportional to the instantaneous flow rate, so that $$\hat{p}_w(\omega)-\hat{p}(r_w,\omega)=-r_wS\frac{d\hat{p}}{dr}(r_w,\omega), \tag{35}$$

where the non-dimensional parameter S is the standard skin factor familiar in well testing. It can be shown that $$\hat{p}(r_w,\omega)=\hat{p}_w(\omega)\frac{K_o\left(\sqrt{\frac{i\omega}{\eta}}\,r_w\right)}{K_o\left(\sqrt{\frac{i\omega}{\eta}}\,r_w\right)+\sqrt{\frac{i\omega}{\eta}}\,r_wSK_1\left(\sqrt{\frac{i\omega}{\eta}}\,r_w\right)}, \tag{36}$$

where the K's are modified Bessel functions, and the branch of the square root is chosen so as to ensure decay of pressure perturbations at large distances.

FIGS. 14 and 15 show graphs of the modulus and argument of $\hat{p}(r_w,\omega)/\hat{p}_w(\omega)$, as given by the above formula, plotted versus $\omega$ or $\omega_D=\omega r_w^2/\eta$ for a variety of values of S. In FIG. 14, the formation permeability is 10 mD, the porosity 20% of the formation fluid viscosity 1 mPa.s, the total compressibility $10^{-8}$ $Pa^{-1}$, the wellbore radius 0.1 m, and the mudcake skin S=99.49 (corresponding to a cake of thickness 1 mm and permeability 0.001 mD). For such a mudcake, the fluid loss rate driven by a 100 psi pressure differential is $6.8\times10^{-5}$ cm/s. From FIG. 15, it can be seen that if the values of $\eta$, $\omega$ and $r_w$, and hence $\omega_D$, are known, then it is possible to estimate the value of S from the measured value of the ratio of the amplitudes of the sandface and wellbore pressure fluctuations, $|\hat{p}(r_w,\omega)/\hat{p}_w(\omega)|$. In the present embodiment, the values of $\hat{p}_w(\omega)$ and $\hat{p}(r_w,\omega)$ are obtained from the measured time series of $p_w(t)$ and $p(r_w,t)$ using standard signal processing methods.

As a further refinement, the drilling fluid circulation rate and/or long-time average wellbore pressure can also be varied. Changes in circulation rate will cause erosion (or further growth) of the mudcake, and changes in filtration pressure will cause the cake to compact (or expand slightly). The cake skin at each circulation rate or overpressure can be estimated using the method just outlined, and by this means a table of values of S versus circulation rate (denoted as $\dot{\gamma}$) and/or filtration pressure ($p_w-p(r_w,t)$, denoted as $\Delta p$) can be created. The values stored in this table can be used in the step of block 1150 (treated further below), so that the value of S corresponding to the current circulation conditions is used when evaluating the leak-off rate. Interpolation between measured values may be used.

Regarding the step of block 1150, the instantaneous pressure drop across the mudcake is related to the sandface pressure gradient by $$p_w(t) - p(r_w, t) = -r_w S(\dot{\gamma}(t), \Delta p(t)) \frac{dp}{dr}(r_w, t), \tag{37}$$

and using Darcy's law at the sandface, $$-\frac{k}{\mu}\frac{dp}{dr}(r_w, t) = q, \tag{38}$$

to relate the sandface pressure gradient to the filtrate leak-off flux, q, one obtains $$q(t) = \frac{k(p_w(t) - p(r_w, t))}{\mu r_w S(\dot{\gamma}(t), \Delta p(t))}. \tag{39}$$

Using this expression, under the assumptions that (a) the fluid loss can be adequately described by the skin parameter S estimated above, and (b) sufficient data has been collected in the previous steps to permit extrapolation and interpolation to estimate S over the range of wellbore flow rates and pressures occurring between first exposure of the formation and the formation pressure measurement (or have a mechanistic model to link values of S measured at one set of wellbore conditions to those pertaining at another), the filtrate loss rate q(t) can be estimated given the measured time histories of wellbore and sandface pressures, $p_w(t)$ and $p(r_w,t)$, respectively and information on the drilling fluid circulation rate.

Regarding steps 1160 and 1170, the sandface pressure is related to the fluid leak-off rate through the familiar convolution integral $$p(r_w, t) = p_\infty + \int_{t_0}^{t} G(t - t')q(t')\,dt', \tag{40}$$

where $t_0$ denotes the time at which the formation was first drilled, $p_\infty$ is the reservoir pressure at great distances from the well, G is the formation impulse response which contains as parameters the formation permeability (k) and pressure diffusivity ($\eta$), and $q(t^1)$ is the filtrate leak-off rate time history estimated as described above. The functional form of G is well known in the art.

By comparing the predicted sandface pressure, given by the previous equation, with the sandface pressures actually measured, $p_\infty$ can be estimated. Stated another way, the quantity $$\int_{t_0}^{t} G(t - t')q(t')\,dt'$$

can be taken as an estimate of the overpressure due to supercharging, and subtracted from measured pressures so as to give an estimate of the true formation pressure. It will be understood that this embodiment relies on an indirect estimation of overpressures from filtercake resistance which affects the accuracy of the technique. The interpretation model assumes that that mudcake is thin, and behaves like a simple additional resistance to fluid flow between wellbore and formation. The technique may be modified to take account of the finite thickness of the cake, unsteady pressure diffusion within the cake itself, and/or interactions between the hydraulic properties of the cake and the changing wellbore pressure.

While the invention has been described with respect to a limited number of embodiments, those skilled in the art, having benefit of this disclosure, will appreciate that other embodiments can be devised which do not depart from the scope of the invention as disclosed herein. For example, embodiments of the invention may be easily adapted and used to perform specific formation sampling or testing operations without departing from the spirit of the invention. Accordingly, the scope of the invention should be limited only by the attached claims.

What is claimed is:

1. A method for determining the virgin formation pressure at a particular depth region of earth formations surrounding a borehole drilled using drilling mud, and on which a mudcake has formed, comprising the steps of:

keeping track of the time since cessation of drilling at said depth region;

deriving formation permeability at said depth region;

causing wellbore pressure to vary periodically in time and determining, at said depth region, the periodic component and the non-periodic component of pressure measured in the formations adjacent the mudcake;

determining, using said time, said periodic component and said permeability, the formation pressure diffusivity and transmissibility and an estimate of the size of the pressure build-up zone around the wellbore at said depth region of the formations;

determining, using said time, said formation pressure diffusivity and transmissibility, and said non-periodic component, the leak-off rate of the mudcake at said depth region;

determining, using said leak-off rate, the pressure gradient in the formations adjacent the mudcake at said depth region; and extrapolating, using said pressure gradient and said size of the pressure build-up zone, to determine the virgin formation pressure.

2. The method as defined by claim 1, wherein said step of determining the periodic component and non-periodic component of pressure measured in the formations adjacent the mudcake includes providing a formation testing device at said depth region, and measuring formation pressure with a probe of said device that is inserted through the mudcake into the formations adjacent the mudcake.

3. The method as defined by claim 2, wherein said step of determining the periodic component and non-periodic component of said pressure measured in formations adjacent the mudcake includes determining, from an average of the pressure measured with said probe, said non-periodic component, and determining, from variations from said average, said periodic component.

4. The method as defined by claim 3, wherein said step of providing a formation testing device comprises providing said device on a wireline in said borehole.

5. The method as defined by claim 3, wherein said step of providing a formation testing device comprises providing said device on a drill string in said borehole.

6. A method for determining the virgin formation pressure at a particular depth region of earth formations surrounding a borehole drilled using drilling mud, and on which a mudcake has formed, comprising the steps of:

causing wellbore pressure to vary periodically in time;

determining, at said depth region, the periodic component and the non-periodic component of pressure measured in the formations adjacent the mudcake;

determining, using said periodic component, an estimate of the size of the pressure build-up zone around the wellbore at said depth region of the formations;

determining, using said non-periodic component, the leak-off rate of the mudcake at said depth region; and determining, using said leak-off rate, and said size of the pressure build-up zone, the virgin formation pressure.

7. The method as defined by claim 6, wherein said step of determining, using said leak-off rate, the virgin formation pressure, includes determining, from said leak-off rate, the pressure gradient in the formations adjacent the mudcake at said depth region, and extrapolating, using said pressure gradient and said size of the pressure build-up zone, to determine said virgin formation pressure.

8. The method as defined by claim 7, further comprising the step of keeping track of the time since cessation of drilling at said depth region, and wherein said time is used in said step of determining an estimate of the size of said pressure build-up zone and in said step of determining said pressure gradient.

9. The method as defined by claim 6, wherein said step of determining the periodic component and non-periodic component of pressure measured in the formations adjacent the mudcake includes providing a formation testing device at said depth region, and measuring formation pressure with a probe of said device that is inserted through the mudcake into the formations adjacent the mudcake.

10. The method as defined by claim 9, wherein said step of determining the periodic component and non-periodic component of said pressure measured in formations adjacent the mudcake includes determining, from an average of the pressure measured with said probe, said non-periodic component, and determining, from variations from said average, said periodic component.

11. The method as defined by claim 9, wherein said step of providing a formation testing device comprises providing said device on a wireline in said borehole.

12. A method for determining the virgin reservoir pressure at a particular depth region of earth formations surrounding a borehole drilled using drilling mud, and on which a mudcake has formed, comprising the steps of:

keeping track of the time since cessation of drilling;

deriving formation permeability at said depth region;

causing wellbore pressure to vary periodically in time, and measuring, at said depth region, the time varying pressure in the borehole and the time varying pressure in the formations adjacent the mudcake;

determining, at said depth region, an estimate of the flow resistance of the mudcake from said derived permeability and components of said measured pressure in the borehole and said measured pressure in the formations adjacent the mudcake;

determining, at said depth region, the leak-off rate of the mudcake from said estimated flow resistance and said measured pressure in the borehole and said measured pressure in the formations adjacent the mudcake;

determining, at said depth region, the pressure excess in the formations adjacent the mudcake from said derived permeability, said leak-off rate, and said time since cessation of drilling; and determining, at said depth region, the virgin reservoir pressure from said measured pressure in the formations adjacent the mudcake and said pressure excess in the formations.

13. The method as defined by claim 12, wherein said step of measuring the time varying pressure in the borehole and the time varying pressure in the formations adjacent the mudcake includes providing a formation testing device at said depth region, and measuring formation pressure with a probe of said device that is inserted through the mudcake into the formations adjacent the mudcake.

14. The method as defined by claim 13, wherein said step of providing a formation testing device comprises providing said device on a wireline in said borehole.

15. The method as defined by claim 13, wherein said step of providing a formation testing device comprises providing said device on a drill string in said borehole.

16. A method for determining the leak-off rate of a mudcake formed, at a particular depth region, on a borehole drilled in formations using drilling mud, comprising the steps of:

deriving formation permeability at said depth region;

causing wellbore pressure to vary periodically in time, and measuring, at said depth region, the time varying pressure in the borehole and the time varying pressure in the formations adjacent the mudcake;

determining, at said depth region, an estimate of the flow resistance of the mudcake from said derived permeability and components of said measured pressure in the borehole and said measured pressure in the formations adjacent the mudcake; and determining, at said depth region, the leak-off rate of the mudcake from said estimated flow resistance and said measured pressure in the borehole and said measured pressure in the formations adjacent the mudcake.

17. The method as defined by claim 16, wherein said step of measuring the time varying pressure in the borehole and the time varying pressure in the formations adjacent the mudcake includes providing a formation testing device at said depth region, and measuring formation pressure with a probe of said device that is inserted through the mudcake into the formations adjacent the mudcake.

18. The method as defined by claim 17, wherein said step of providing a formation testing device comprises providing said device on a wireline in said borehole.

19. The method as defined by claim 17, wherein said step of providing a formation testing device comprises providing said device on a drill string in said borehole.

20. The method as defined by claim 16 further comprising:

determining over a time interval a circulation rate and a corresponding overbalance pressure of the borehole;

determining, over the time interval, the leak-off rate for each circulation rate and corresponding overbalance pressure of the borehole;

determining, over the time interval, a relationship between the leak-off rate and each circulation rate and corresponding overbalance pressure; and estimating the leak-off rate for a previous time interval based on the determined relationship.

21. The method as defined by claim 20 further comprising:

adjusting the measured formation pressure based on the estimated leak-off rate.

* * * * *